US006112834A

United States Patent [19]

Barrett

[11] Patent Number: 6,112,834

[45] Date of Patent: Sep. 5, 2000

[54] BLAST HOLE DRILL INCLUDING A SLACK TAKE-UP REEL

[75] Inventor: Rhodes C. Barrett, Oconomowoc, Wis.

[73] Assignee: Harnischfeger Technologies, Inc., Wilmington, Del.

[21] Appl. No.: 09/189,735

[22] Filed: Nov. 10, 1998

[51] Int. Cl.[7] ..... E21B 19/08

[52] U.S. Cl. ..... 175/162

[58] Field of Search ..... 175/162, 122, 175/220; 173/152, 147, 185, 184, 156, 27, 28

[56] References Cited

U.S. PATENT DOCUMENTS 3,181,630 5/1965 Coburn ..... 175/220
3,313,359 4/1967 Ross et al. .
3,766,996 10/1973 Moody et al. .
4,020,909 5/1977 Airaudo ..... 173/152
4,258,796 3/1981 Horning et al. ..... 173/28
5,709,277 1/1998 Geldner ..... 175/122

*Primary Examiner*—Thomas B. Will
*Assistant Examiner*—Kristine Markovich
*Attorney, Agent, or Firm*—James Earl Lowe, Jr.

[57] ABSTRACT

A drill comprising a frame supported for movement over the ground, a mast pivotally mounted on the frame, a drill head moveable up and down the mast, the drill head being selectively engageable with the upper end of a drill pipe so that the drill pipe is raised and lowered out of and into the ground when the drill head moves up and down the mast, an elongated flexible member, such as a power line or an air hose, extending between the frame and the drill head, and a device for taking up any slack in the elongated member as the drill head moves up and down the mast.

10 Claims, 2 Drawing Sheets

BLAST HOLE DRILL INCLUDING A SLACK TAKE-UP REEL

BACKGROUND OF THE INVENTION

A type of drilling equipment known as a blast hole drill is widely used in surface mining and quarrying operations to drill holes of moderate depth. Explosives are lowered to the bottom of these holes and detonated to break up rock and other hard earth formations. This permits the excavation of the material disintegrated by the blast and allows expansion of the area being mined or quarried. This equipment is typically mobile—being mounted on a vehicle that travels on crawlers. The vehicle has a cab for operating personnel and a housing for the machinery that drives the unit. A long, pivoting mast or drill tower is disposed horizontally when the unit is on the move, and is set upright for vertical drilling operations. The mast carries a number of individually stored pipes arranged longitudinally therein. These pipes are connected one at a time in a drill string as a hole is being drilled. A movable carriage on the mast moves down and up the mast as the pipe moves into and out of the ground. An air hose supplies air to the drill string and power lines supply power to the carriage. The air hose and supply lines run from the machine housing up to the carriage and must include slack in order to be able to move up and down with the carriage. This slack hangs down and can get entangled with or damaged by the mast. In order to limit damage to the air hose and the supply lines, a tray has been attached to the mast, and the slack laid in the tray. Often, however, the slack hose or lines would get entangled in the tray, or would fall out of the tray when the mast was moved from its vertical position, such as in certain mining operations, where it is advantageous to position the mast at an angle, up to 30°, to drill a hole at that angle.

SUMMARY OF THE INVENTION

This invention provides a drill comprising a frame supported for movement over the ground, a mast pivotally mounted on the frame, a drill head moveable up and down the mast, the drill head being selectively engageable with the upper end of a drill pipe so that the drill pipe is raised and lowered out of and into the ground when the drill head moves up and down the mast, an elongated flexible member, such as a power line or an air hose, extending between the frame and the drill head, and a device for taking up any slack in the elongated member as the drill head moves up and down the mast.

In one embodiment, the slack take up device is a slack take-up reel around which the elongated member extends, the reel being movable up and down the mast for taking up any slack in the elongated member as the drill head moves up and down the mast.

In one embodiment, the elongated member extends upward along the mast and is fixed to the mast at a point above the reel, wherein the elongated member extends downward from the point, around the reel, and upward from the reel to the drill head, and wherein the reel is biased downward by the force of gravity so that the reel moves downward as the drill head moves downward and moves upward as the drill head moves upward.

Figure 1:
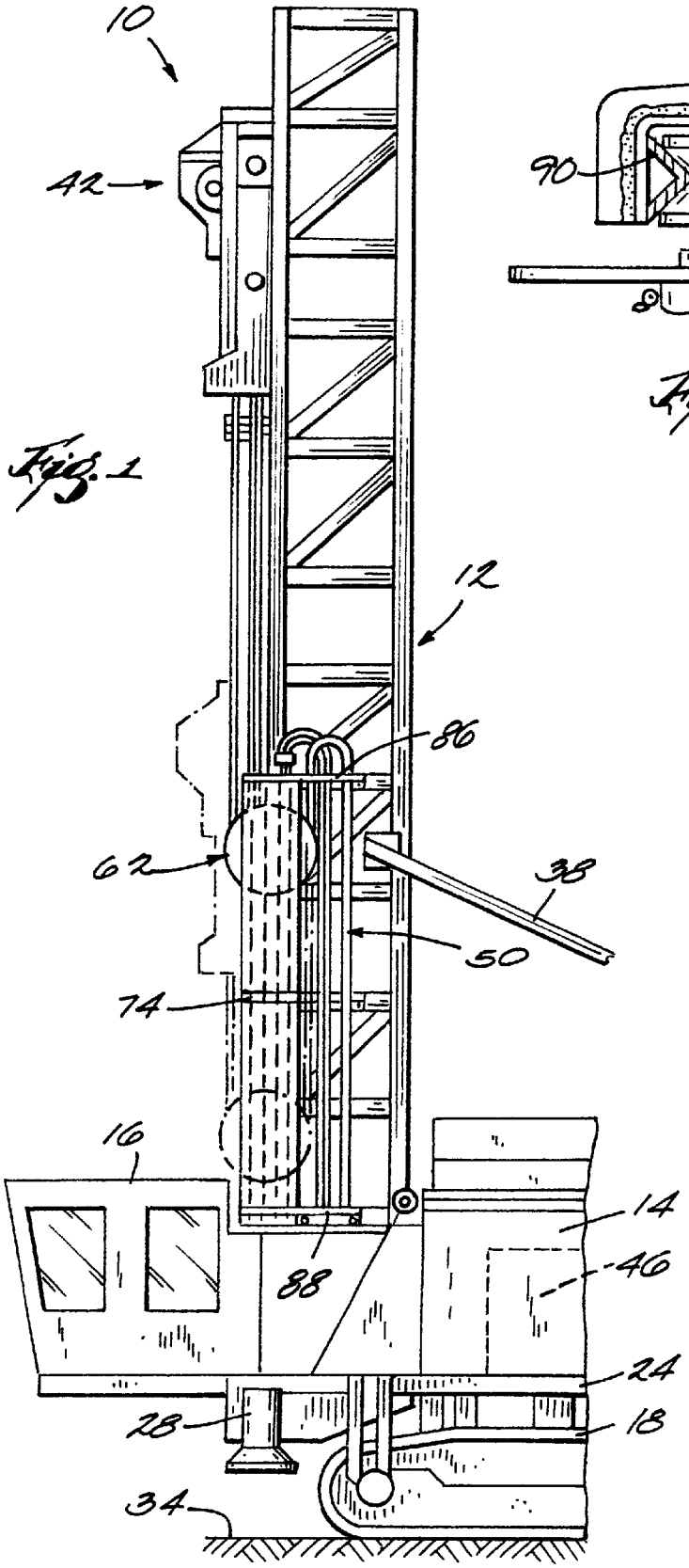
FIG. 1 is a side elevational view of a blasthole drill embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof.

DETAILED DESCRIPTION OF THE PREFERRED EMBODIMENT

Figure 2:
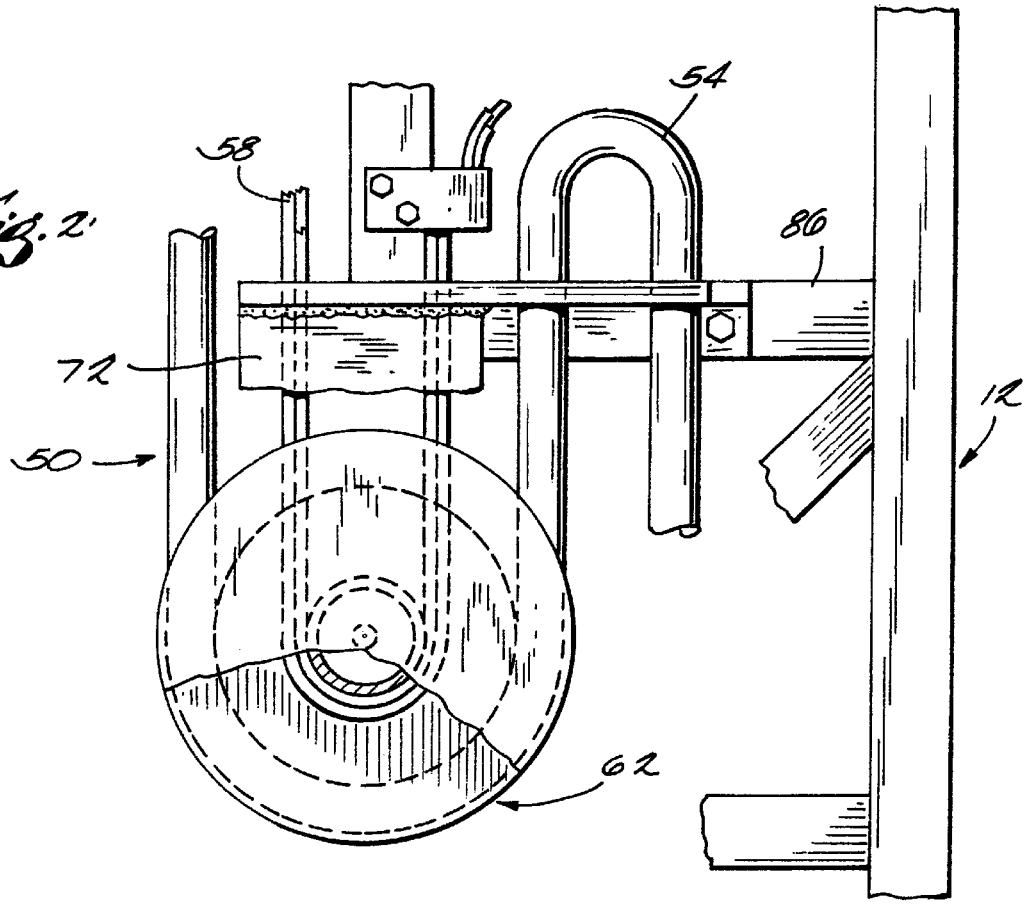
FIG. 2 is a partially broken away side view of part of the drill tower or mast with a hose support plate and a slack take-up device.

With reference to FIGS. 1 and 2, a blasthole drill 10 is shown as having a mast or drill tower 12, a machinery house 14, an operator's cab 16, a crawler drive 18, and a ladder (not shown) providing access to the cab 16 and machinery house 14. The machinery house 14 and cab 16 are supported on top of a frame or deck 24, and the deck 24 is supported by the crawlers for movement over the ground. The drill tower 12 is pivotally connected to the frame or deck 24 and supports a drill pipe (not shown) which projects through an opening (not shown) in the deck 24 and which extends downward into the ground 34. A plurality of drill pipes can be connected together to form a drill string. The invention can also be applied to units carried on different mobilizing elements, such as tire-bearing wheels.

Rising upwardly in FIG. 1, the elongated drilling mast 12 has been positioned for drilling a hole into the earth. When moved from place to place, the drilling mast 12 is carried horizontally, along and just above the top of the machinery housing 14. At the drilling site, the unit 10 is stopped, raised off the crawlers 18 and stabilized using at least three leveling jacks 28 such as the one seen at the front end of the unit 10 in FIG. 1. The mast 12 is then raised to the vertical position shown in FIG. 1. The mast 12 may also be tilted to angular drilling positions in increments of 5° from vertical, up to a maximum of 30° from vertical. The mast 12 is raised by operation of a hydraulic cylinder (not shown) and is supported by a brace 38, which is unfolded as the mast 12 is raised, and which is locked when the mast 12 reaches the desired position. Such a brace is disclosed in Lang et al, U.S. Pat. No. 3,805,463 issued Apr. 23, 1974.

The mast 12 is an open lattice structure with a longitudinal axis and having a back and two sides. There are two opposing tracks (not shown) extending longitudinally along the mast 12, and a movable carriage and drill head 42 is driven up and down along these tracks. The drill head 42 carries a rotatable coupling (not shown) with a downwardly opening, threaded socket that attaches to the upper end of the drill pipe. The drill head 42 also carries one or more motors (not shown) to rotatably drive the coupling and all pipes attached thereto. The motors may be electric, hydraulic or pneumatic.

The drill 10 further includes an air compressor 46 within the machinery housing 14, and elongated flexible members 50 which extend to the movable carriage and the drill head 42 from the machinery housing 14. More particularly, the flexible members comprise an air hose 54 and a plurality of power lines 58, either electric or hydraulic, which extend from the machinery housing 14 to the drill head 42 to power the drill head motors.

Still more particularly, the air hose 54 extends to the movable carriage and the drill head 42 from the air compressor 46 so that the air hose 54 communicates with the open end of the drill pipe so air from the air compressor 46 communicates through the air hose 54 and the drill string with the bottom of the drill string so cut earth pieces are blown out of the drill hole.

The drill 10 further includes a device for taking up any slack in the elongated members 50 as the drill head 42 moves up and down the mast 12. More particularly, the slack take-up device is a slack take-up reel assembly including spaced-apart wheels 64 and 66 movable along spaced-apart wheel tracks 68 and 72 mounted on the side of the drill tower or mast 12 and extending parallel to the drill tower longitudinal axis, and a reel 62 rotable about an axis common to the wheels.

In the preferred embodiment, the reel 62 comprises a larger diameter inner air hose pulley 76 and two outer smaller diameter power line pulleys 80 and 84. The pulleys may, in other embodiments, be permitted to rotate relative to each other, or, in the preferred embodiment, fixed relative to each other, with the diameter sized appropriately to adequately take up the slack in the power lines 58 and the air hose 54.

The drill 10 further includes a support plate 86 secured to the side of the drill tower 12, and the air hose 54 and the power lines 58 extend from the frame or deck 24 up alongside the drill tower 12 to the support plate 86 where the air hose 54 and the power lines 58 are secured to the support plate 86 (or to the drill tower 12 in other embodiments), and then further extend downwardly from the support plate 86, around the slack take-up reel 62, and then back up to where the air hose 54 and the power lines 58 are connected to the movable carriage and drill head 42.

Figure 3:
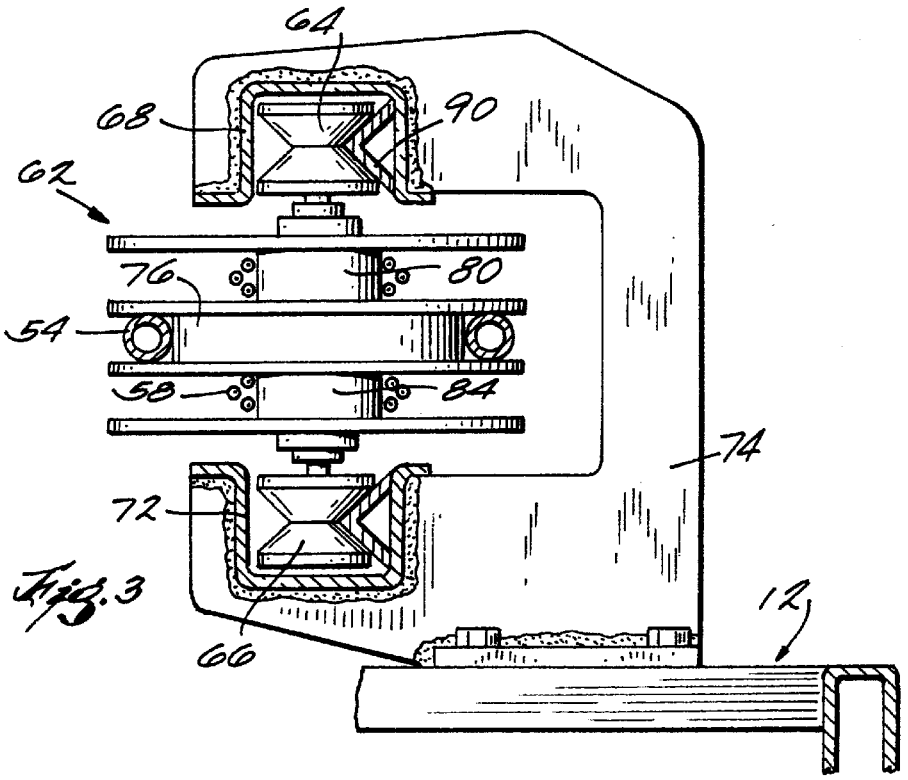
FIG. 3 is a plan view of a portion of the mast of FIG. 1 and showing wheel tracks, a mounting plate, and the slack take-up device of this invention.

The support plate 86, together with a mounting plate 74 (see FIGS. 1 and 3) and another support plate 88, mount the wheel tracks 68 and 72 to the mast 12. As more particularly shown in FIG. 3, the mounting plate 74 is U-shaped in order to permit the reel 62 to pass through the mounting plate 74.

Figure 4:
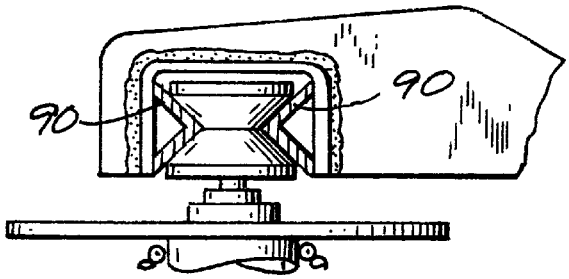
FIG. 4 is an alternate embodiment of the wheel track shown in FIG. 3.

The drill 10 further includes means to hold the wheels 64 and 66 on the tracks 68 and 72. In the preferred embodiment, the wheels are bearings or rollers including a V-groove, and the means to hold the wheels in the track includes one V-channel 90 on each track and received in the V-grooves and secured to the tracks. In other embodiments, two V-channels on each track (see FIG. 4) can be used, or no V-channel and a removable retaining wall (not shown) or other means to retain the wheels in the tracks can be used.

The drill 10 further includes means to bias the slack take-up reel 62 away from the carriage 42. In the preferred embodiment, the slack take up reel 62 is below the movable carriage 42 and the weight of the reel 62 biases the reel 62 downwardly, thereby taking up any slack in the air hose 54 and power lines 58 and preventing the air hose 54 and power lines 58 from leaving the drill tower 12 and becoming entangled with or abraded by other equipment as the movable carriage 42 moves down the mast 12, as shown in ghost in FIG. 1. In other embodiments, a compression spring (not shown) between the support plate 86 and the reel 62 or between the reel 62 and the wheels 64 and 68 could be used.

In still other embodiments (not shown), the slack take-up reel 62 could be biased upwardly and movably mounted above the movable carriage 42.

What is claimed is:

1. A drill comprising a frame supported for movement over the ground, a mast supported pivotally mounted on said frame, said mast having a longitudinal axis, a drill head moveable up and down said mast, said drill head being selectively engageable with the upper end of a drill pipe so that the drill pipe is raised and lowered out of and into the ground when said drill head moves up and down said mast, an elongated flexible member extending between said frame and said drill head, and a slack take-up reel around which said elongated member extends, said reel being movable up and down said mast for taking up any slack in said elongated member as said drill head moves up and down said mast.

2. A drill as set forth in claim 1 wherein said elongated member extends upward along said mast and is fixed to said mast at a point above said reel, wherein said elongated member extends downward from said point, around said reel, and upward from said reel to said drill head, and wherein said reel is biased downward so that said reel moves downward as said drill head moves downward and moves upward as said drill head moves upward.

3. A drill as set forth in claim 2 wherein said reel is biased downward by the force of gravity.

4. A drill including a frame supported by crawlers for movement over the ground, a drill tower pivotally connected to said frame and having a longitudinal axis, a support plate secured to the side of the drill tower, a carriage movably supported on the drill tower and including a rotary drive head for clamping onto and rotating a drill pipe so that the drill pipe is raised and lowered out of and into the ground when the carriage moves up and down the tower, a machinery housing on the frame, spaced-apart wheel tracks mounted on the side of the drill tower and extending parallel to said drill tower longitudinal axis, a slack take-up reel assembly including wheels movable along the tracks, and a reel rotatable about an axis common to said wheels, means to hold the wheels on the tracks, power lines which extend to the movable carriage and the drill head from the machinery housing, an air compressor within the machinery housing, an air hose which extends to the movable carriage and the drill head from the air compressor so that the air hose communicates with the open end of the drill pipe so air from the air compressor communicates through the air hose and the drill string with the bottom of the drill string so cut earth pieces are blown out of the drill hole, the air hose and the power lines extending from the frame up along side the drill tower to the support plate where said air hose and said power lines are secured to the support plate, and then further extending from the support plate, around the slack take-up reel, and then back up to where the air hose and the power lines are connected to the movable carriage and, and means to bias the slack take-up reel away from the carriage.

5. A drill according to claim 4 wherein the power lines include electrical cables.

6. A drill according to claim 4 wherein the power lines include hydraulic hoses.

7. A drill according to claim 4 wherein the reel further includes a larger diameter inner air hose pulley and two outer smaller diameter power line pulleys.

8. A drill according to claim 4 wherein the pulleys are fixed relative to each other and the diameter of each of said pulleys is sized appropriately to adequately take up the slack in the power lines and the air hose.

9. A drill according to claim 4 wherein the wheels are rollers including a V-groove, and the means to hold the wheels in the track includes two V-channels received in the V-grooves and secured to the tracks.

10. A drill according to claim 4 wherein the slack take up reel is below the movable carriage and the weight of the reel biases the reel downwardly, thereby taking up any slack in the air hose and power lines and preventing the air hose and cables from leaving the drill tower and becoming entangled with or abraded by other equipment.

* * * * *